United States Patent [19]

Kiewert et al.

[11] 4,343,725

[45] Aug. 10, 1982

[54] CLEANSERS FOR WINDOWS, MIRRORS AND REFLECTING SURFACES CONTAINING A HIGH MOLECULAR WEIGHT POLYOXYETHYLENE GLYCOL POLYMER

[75] Inventors: Eva Kiewert, Düsseldorf; Karlheinz Disch, Haan; Jürgen Wegner, Düsseldorf, all of Fed. Rep. of Germany

[73] Assignee: Henkel Kommanditgesellschaft auf Aktien (Henkel KGaA), Düsseldorf-Holthausen, Fed. Rep. of Germany

[21] Appl. No.: 71,120

[22] Filed: Aug. 30, 1979

[30] Foreign Application Priority Data

Sep. 16, 1978 [DE] Fed. Rep. of Germany ..... 2840464

[51] Int. Cl.[3] ..... C11D 1/58; C11D 1/72

[52] U.S. Cl. ..... 252/542; 252/173; 252/174.14; 252/174.21; 252/174.22; 252/174.23; 252/544; 252/548; 252/550; 252/551; 252/558; 252/559; 252/DIG. 10; 252/DIG. 14

[58] Field of Search ..... 252/174.21, 174.22, 252/174.23, 173, 550, 551, 558, 559, DIG. 10, DIG. 14, 542, 548, 544, 174.14

[56] References Cited

U.S. PATENT DOCUMENTS

| | | | |
|---|---|---|---|
| 2,955,047 | 10/1960 | Terry | 106/3 |
| 3,342,740 | 9/1967 | Kazmierczak | 252/153 |
| 3,463,735 | 8/1969 | Stonebraker | 252/171 X |
| 3,696,042 | 10/1972 | Wright | 252/153 |
| 3,696,043 | 10/1972 | Labarge et al. | 252/153 |
| 3,728,269 | 4/1973 | Stephenson et al. | 252/171 |
| 3,819,522 | 6/1974 | Zmoda et al. | 252/174.21 |
| 3,939,090 | 2/1976 | Zmoda | 252/90 |
| 3,944,663 | 3/1976 | Weiss et al. | 424/78 |
| 3,989,633 | 11/1976 | Frisque | 252/11 |
| 4,054,534 | 10/1977 | Angelini | 252/158 |
| 4,175,062 | 10/1979 | Disch et al. | 252/540 |
| 4,213,873 | 7/1980 | Church | 252/174.21 |

FOREIGN PATENT DOCUMENTS

| | | | |
|---|---|---|---|
| 2603290 | 8/1977 | Fed. Rep. of Germany | 252/174.23 |

OTHER PUBLICATIONS

Davidson et al., "Water Soluble Resins", First Ed., 1962, Reinhold Publishing Co., N.Y., Chapter 9–"Ethylene Oxide Polymers", pp. 169–198.

Harding et al., "Ethylene Oxide Polymers", Technical Center, Union Carbide, South Charleston, W.V., pp. 191–195.

*Primary Examiner*—P. E. Willis, Jr.

*Attorney, Agent, or Firm*—Hammond & Littell, Weissenberger and Muserlian

[57] ABSTRACT

Aqueous-based cleansers for windows, mirrors and reflecting surfaces, free of builder salts and organic solvents consisting essentially of:

- from 0.1% to 0.5% by weight of a water-soluble, nonionic polyoxyethylene glycol polymer having a molecular weight of between 300,000 and 4,000,000,
- from 0.1% to 5% by weight of at least one water-soluble, synthetic surface-active compound selected from the group consisting of synthetic anionic surface-active compounds, nonionic surface-active compounds, cationic surface-active compounds, and compatible mixtures thereof,
- from 0% to 5% by weight of water-soluble, alkaline-reacting compounds,
- from 0% to 1% by weight of customary auxiliary agents selected from the group consisting of odorants, colorants and preservatives,
- and the remainder to 100% by weight of demineralized water.

The aqueous-based cleansers of the invention dry streak free and give an antifogging effect.

10 Claims, No Drawings

CLEANSERS FOR WINDOWS, MIRRORS AND REFLECTING SURFACES CONTAINING A HIGH MOLECULAR WEIGHT POLYOXYETHYLENE GLYCOL POLYMER

BACKGROUND OF THE INVENTION

The present invention relates to aqueous-based cleansers for glass, particularly for windows, mirrors and reflecting surfaces which are free of builder salts and organic solvents. Hereinafter such cleansers will be referred to as "window cleansers."

Window cleansers, when used in the household, mostly come in contact with the skin of the hands of the user. They must therefore be correspondingly mild, that is, they should affect and cause as little as possible damage not only to the skin, but also to the areas surrounding the glass, of varnish, wood, leather, etc. Beyond that, they must be sufficiently effective to remove the grease-containing and pigment-containing dirt from window panes, mirrors, glass bricks, automobile windows, and similar reflecting surfaces. Finally, the cleaned surfaces should rapidly dry free of streaks, without requiring mechanical repolishing.

Such preparations generally contain ammonia and/or an organic surface-active compound of high wetting capacity in aqueous solution, to which water-soluble, organic solvents like low molecular weight aliphatic alcohols, glycols, glycol ethers or acetone are added.

From U.S. Pat. No. 4,101,456, corresponding cleansers are known which allow keeping glass surfaces spot-free during cleaning and rinsing, without separate drying. These are aqueous preparations which contain from 0.01% to 1% by weight of a water-soluble surface-active agent, and a water-soluble, non-proteinaceous cationic polymer with a molecular weight of 25,000 to 10,000,000, where the weight ratio of the surface-active compound to the polymer in the washing fluid is about 2:1 to about 1,000:1. With these preparations, however, it is recommended to rinse the glass surface before letting it dry (column 1, lines 42–44). This is not always possible when cleaning large glass surfaces in the household, for example, window panes in living areas, but which in any case is inconvenient. Another disadvantage of these cationic polymers is their incompatibility with many anionic compounds and therefore the customary addition of anionic surface-active compounds is greatly limited.

According to the teachings of U.S. Pat. No. 3,696,043, about 0.03% to 2% by weight of a soluble polymeric salts was therefore added to aqueous or aqueous-alcoholic window cleansers containing 0.01% to 5% by weight of a nonionic or anionic surface-active agent, and alkaline-reacting compound, if necessary, to give solubilizing salt groups. The polymeric acid consists of a copolymer of 1 to 2 mols of a monovinyl-aromatic monomer per mol of an unsaturated dicarboxylic acid or its anhydride. The polymeric acid is neutralized with a sufficient amount of ammonia, an alkali metal base or an amine to cause the formation of solubilizing salt groupings. This composition is said to reduce the formation of streaks on the cleaned surfaces and fogging at high humidity, and to impart to them a dust-repelling finish.

These preparations which contain the polymer salts claimed there in the lower amounts of the claimed concentration range, have a good antifogging effect on slightly soiled window panes or mirrors, but they have a very low cleansing effect. On naturally soiled windows, which have been exposed on the inside to cigarette smoke or central heating air, and on the outside to the exhaust air of heavy street traffic, the cleaning power is by far inadequate. The result is smearing of the dirt components not absorbed by the liquor on the pane surface, so that a film or streaks remain after cleaning, hence unsatisfactory cleaning. If the content of polymer salt is increased, on the other hand, but still within the claimed concentration range, the removal of dirt is improved, but residues from the cleaning liquor remain on the glass surface. These residues cannot be removed by dry polishing, and it is therefore necessary to rinse with clean water.

According to the teachings of U.S. Pat. No. 3,939,090, 0.01% to 0.1% by weight of a copolymer of an ethylenically-unsaturated dicarboxylic acid anhydride or partial ester thereof with an ethylenically-unsaturated monomer that is free of carboxyl groups, are added to window cleansers to improve their cleaning action, which copolymer can have a molecular weight of about 400 to about 2,000,000. The addition of solvents is absolutely necessary for the preparation to display its full activity.

OBJECTS OF THE INVENTION

It is an object of the present invention to develop an aqueous-based window cleanser which is free of the drawbacks of the prior art and which gives excellent washing results, dries to a streak-free condition and has a good antifogging effect.

Another object of the present invention is the development of aqueous-based cleansers for windows, mirrors, and reflecting surfaces, free of builder salts and organic solvents consisting essentially of:

- from 0.01% to 0.5% by weight of a water-soluble, nonionic polyoxyethylene glycol polymer having a molecular weight of between 300,000 and 4,000,000,
- from 0.1% to 5% by weight of at least one water-soluble, synthetic surface-active compound selected from the group consisting of synthetic anionic surface-active compounds, nonionic surface-active compounds, cationic surface-active compounds, and compatible mixtures thereof,
- from 0 to 5% by weight of water-soluble, alkaline-reacting compounds,
- from 0 to 1% by weight of customary auxiliary agents selected from the group consisting of odorants, colorants and preservatives,
- and the remainder to 100% by weight of demineralized water.

These and other objects of the invention will become more apparent as the description thereof proceeds.

DESCRIPTION OF THE INVENTION

It was found that the disadvantages of the known polymer additions to window cleansers can be eliminated by adding small amounts of nonionic polymers, namely, polyoxyethylene glycols with molecular weights of between 300,000 and 4,000,000, preferably between 500,000 and 1,000,000 to a window cleanser based on an aqueous surface-active compound-containing solution, which is free of builder salts and solvents. Particularly surprising was the unexpectedly great increase in cleansing power by the incorporation of very small amounts of these polymers which have good antifogging action corresponding to that of the known ionic polymers.

In addition, the polyoxyethylene glycols used according to the invention are capable of reducing the friction resistance during the wiping of the glass surfaces so that the wiping is facilitated. Furthermore they are characterized, compared to the known added polymers, by the fact that they are compatible with practically all surface-active compounds used, and that the window cleansers to which they are added require neither solvents nor rinsing with clear water.

The present invention, therefore, concerns aqueous cleansers which are free of builder salts and solvents for cleaning glass, particularly windows, mirrors and reflecting surfaces, with a content of water-soluble polymers, which are characterized in that they contain:

- 0.01% to 0.5% by weight, preferably 0.05% to 0.2% by weight, of a water-soluble, nonionic polymer from the group of the polyoxyethylene glycols with molecular weights of between 300,000 and 4,000,000, preferably between 500,000 and 1,000,000,
- 0.1% to 5%, preferably 0.5% to 5%, by weight of synthetic anionic, nonionic or cationic surface-active compounds or suitable mixtures thereof,
- 0 to 5%, preferably 0.1% to 2%, by weight of a basic compound, and
- the balance to 100% by weight of demineralized water, as well as other optional auxiliary substances, particularly perfumes and colorants, as well as preservatives.

More particularly, the present invention relates to aqueous-based cleansers for windows, mirrors and reflecting surfaces, free of builder salts and organic solvents consisting essentially of:

- from 0.01% to 0.5% by weight of a water-soluble, nonionic polyoxyethylene glycol polymer having a molecular weight of between 300,000 and 4,000,000,
- from 0.01% to 5% by weight of at least one water-soluble, synthetic surface-active compound selected from the group consisting of synthetic anionic surface-active compounds, nonionic surface-active compounds, cationic surface-active compounds and compatible mixtures thereof,
- from 0 to 5% by weight of water-soluble, alkaline-reacting compounds,
- from 0 to 1% by weight of customary auxiliary agents selected from the group consisting of odorants, colorants and preservatives,
- and the remainder to 100% by weight of demineralized water.

The window cleansers of the invention can be diluted with water in a ratio of 1:10 to 1:100 to a so-called household solution. The household solution can be applied on the glass surfaces by means of a sponge or cloth, or can be sprayed directly on the surface by means of a spray pump and be wiped off immediately with a chamois, a rubber squeegee wiper, a cloth, or a paper towel. Subsequent wiping or dry polishing is not necessary.

The above-mentioned polyoxyethylene glycols are prepared in known manner by subjecting ethylene glycol in known manner to a polycondensation process. They can also be considered as condensation polymers of ethylene oxide with ethylene glycol or water. They have the general formula:

$$HO\text{-}(CH_2\text{—}CH_2\text{—}O)_n H$$

where n can vary between 4,800 and 64,600 in the case of polyoxyethylene glycols according to the invention. These polymers are commercially available and are distributed by Union Carbide Corporation (UCC) under the name "POLYOX" ®.

The surface-active compounds and surface-active compound mixtures that can be used are synthetically produced and are practically unlimited. Only soaps should be avoided because of their tendency to form lime spots in cold water, and the known incompatibility of most mixtures of anionic and cationic surface-active compounds should be kept in mind.

The synthetic surface-active compounds contain at least one hydrophobic organic radical and one water-solubilizing anionic, nonionic or cationic radical in the molecule. The hydrophobic radical is mostly an aliphatic hydrocarbon radical with 8 to 26, preferably 10 to 22 and particularly 12 to 18, carbon atoms, or an alkylaromatic radical with 6 to 18, preferably 8 to 16, aliphatic carbon atoms.

The synthetic surface-active compounds which can be used are preferably those of the type of the sulfonates, sulfates and synthetic carboxylates.

Suitable as anionic surface-active compounds of the sulfonate type are the alkylbenzene sulfonates ($C_{9-15}$-alkyl), mixtures of alkene and hydroxyalkane sulfonates, as well as alkane disulfonates, as they are obtained, e.g., from monoolefins with terminal or nonterminal double bonds by sulfonation with gaseous sulfur trioxide and subsequent alkaline or acid hydrolysis of the sulfonation groups. Also suitable are alkane sulfonates obtained from alkanes by sulfochlorination or sulfoxidation and subsequent hydrolysis or neutralization or by the addition of bisulfite onto olefins. Other suitable surfactants of the sulfonate type are the esters of $\alpha$-sulfo-fatty acids derived from hydrogenated methyl or ethyl esters of coconut fatty acids, palm kernel fatty or tallow fatty acids.

Suitable surface-active compounds of the sulfate type are the sulfuric acid monoesters of primary alcohols, particularly alkanols or fatty alcohols, such as from coconut fatty alcohols, tallow fatty alcohols or oleyl alcohols and those sulfuric acid half esters of secondary alcohols. Also suitable are sulfated fatty acid alkanolamines, sulfated fatty acid monoglycerides, or sulfated reaction products of 1 to 4 mols of ethylene oxide with primary or secondary fatty alcohols or alkylphenols.

Other suitable synthetic anionic surface-active compounds are the fatty acid esters or amides of hydroxycarboxylic acids or aminocarboxylic acids or the corresponding hydroxy or amino sulfonic acids, such as the fatty acid sarcosides, fatty acid glycolates, fatty acid lactates, fatty acid taurides or fatty acid isothionates.

The synthetic anionic surface-active compounds can be used in the form of their alkali metal, alkaline earth metal and ammonium salts, as well as in the form of their water-soluble salts of organic bases, such as alkylamines and alkylolamines. The sodium salts are mostly preferred for reasons of cost.

Suitable as nonionic surface-active compounds are adducts of 4 to 40, preferably 4 to 20, mols of ethylene oxide onto 1 mol of fatty alcohols, alkane diols, alkylphenols, fatty acids, fatty amines, fatty acid amides, or alkane sulfonamides. Particularly important are the adducts of 5 to 16 mols of ethylene oxide or mixtures of ethylene oxide and propylene oxide onto coconut fatty alcohols or tallow fatty alcohols, or oleyl alcohol, or onto secondary alkanols with 8 to 18, preferably 12 to 18, carbon atoms, as well as onto mono or dialkylphenols with 6 to 14 carbon atoms in the alkyl radicals. Where mixtures of ethylene oxide and propylene oxide adducts are utilized, the amount of ethylene oxide adducted should exceed the amount of propylene oxide adducted. In addition to these water-soluble nonionic surface-active compounds, water insoluble or not completely water-soluble polyglycol ethers with 1 to 4 ethylene glycol ether radicals in the molecule are also of interest, particularly if they are used together with water-soluble nonionic or anionic surface-active compounds.

Also suitable as nonionic surface-active compounds which can be used are the water-soluble adducts of ethylene oxide onto polypropylene oxide, alkylene diamine polyoxypropylene glycol or alkylene polyoxypropylene glycol with 1 to 10 carbon atoms in the alkylene, containing 20 to 250 ethylene glycol ether groups and 10 to 100 propylene glycol ether groups, where the polyoxypropylene glycol chain acts as a hydrophobic radical.

Nonionic surface-active compounds of the type of the amineoxides can also be used. Typical representatives are:

N-dodecyl-N,N-dimethylamineoxide,
N-tetradecyl-N,N-dihydroxyethylamine oxide,
N-hexadecyl-N,N-bis-(2,3-dihydroxypropyl-)amineoxide, etc.

The cationic surface-active compounds contain at least one hydrophobic and at least one basic water-solubilizing radical, optionally, in the form of a salt. The hydrophobic radical is an aliphatic or cycloaliphatic hydrocarbon radical with preferably 10 to 22 carbon atoms, or an alkyl or cycloalkyl aromatic radical with preferably 8 to 16 carbon atoms in the alkyl or cycloalkyl. The basic water-solubilizing radicals are primarily basic nitrogen atoms of which several can be present in a molecule. These are preferably quaternary ammonium compounds, such as:

N-dodecyl-N,N,N-trimethyl ammonium methosulfate,
N-hexadecyl-N,N,N-trimethylammonium chloride,
N-octadecyl-N,N,N-trimethylammonium chloride,
N,N-dicocoalkyl-N,N-dimethylammonium chloride,
N-dodecyl-N,N-dimethyl-N-benzylammonium bromide, the reaction product of 1 mol of tallow alkylamine with 10 mols of ethylene oxide,
N-dodecyl-N,N',N'-trimethyl-1,3-diaminopropane,
N-hexadecyl pyridinium chloride, etc.

The corresponding compounds with a quaternary phosphorus atom or with a tertiary sulfur atom can be substituted for the above-mentioned nitrogen compounds.

Preferably either a synthetic anionic surface-active compound of the sulfonate or sulfate type or a mixture of synthetic anionic surface-active compounds of the sulfonate or sulfate type and nonionic surface-active compounds are employed in the window cleansers of the present invention. Where mixtures are employed the ratio of anionic to nonionic can be from 100:1 to 1:20. Therefore, in the preferred embodiment, the water-soluble synthetic surface-active compounds are synthetic anionic surface-active compounds of the sulfonate and sulfate types and nonionic surface-active compounds in a ratio of 100:0 to 1:20, present in the window cleanser in an amount of from 0.5% to 5% by weight.

The basic inorganic compound are water-soluble alkaline-reacting compounds, such as the hydroxides, carbonates and bicarbonates of the alkali metals, such as sodium, potassium or lithium, or ammonium, as well as basic organic compounds, such as amines, like monoalkylamines, dialkylamines and trialkylamines with 1 to 4 carbon atoms in the alkyl radical, the corresponding mono-, di-, or trialkanolamines with 2 to 4 carbon atoms in each alkylol, cycloalkylamines, like cyclohexamine, heterocyclic amines like morpholine, etc. Ammonia in the form of ammonium hydroxide, and triethanolamine are preferred. The water-soluble alkaline-reacting compounds are employed in amounts of from 0 to 5%, preferably from 0.1% to 2%, by weight.

The preservatives which can be used are antimicrobial substances which are generally employed for aqueous surface-active compound solutions, such as formaldehyde, benzoates, phenol derivatives and the like. The addition of colorants and perfumes are variable and depend on the availability, their stability in slightly alkaline aqueous cleansers and of the respective vogue. The odorants, colorants and preservatives are employed in amounts of from 0 to 1%, preferably 0.0001% to 0.2%, by weight.

TESTING METHODS

The antifogging effect was tested under laboratory conditions by carefully cleaning and drying mirrors of 40×50 cm, marking a center line with a wax pencil, and then treating one half with a cleanser according to the invention and the other half with a reference product. After drying in air, vessels of equal size filled with boiling water were placed in front of both mirror halves and the fogging on the mirror was observed.

This laboratory method was checked in practice by treating a bathroom mirror as described above and subsequently turning on the shower with hot water so that steam was formed in the bathroom. The fogging of the mirror halves was observed. Complete agreement was found in all cases between the laboratory method and the practical test.

The cleaning action, the ease of wiping, the formation of streaks and the resoiling behavior were tested on window panes which had been soiled to a various degree by different environmental conditions. The window cleanser according to the invention and a reference product were again applied directly on juxtaposed surfaces, and the results compared. The window panes employed in the test were inside panes of small rooms which were exposed to heavy tobacco smoke, or outside panes which had been exposed to dirt caused by heavy street traffic.

Finally, the window cleanser according to the invention and a reference product were made available to professional window cleaners for the duration of several weeks. They were subsequently asked about their experiences with these products. The results can be seen from the following examples.

The composition of the reference product corresponded to that of the window cleanser according to the invention, but it contained, as a polymer, a styrene/maleic anhydride copolymer with a molecular weight of about 2,300, as described in U.S. Pat. No. 3,696,043.

The following examples are illustrative of the practice of the invention without being limitative in any respect.

EXAMPLE 1

A window cleanser of the following composition was prepared:

| Percent by Weight | |
|---|---|
| 1.5 | An adduct of ethylene oxide and propylene oxide onto an oxo-alcohol (commercial product "Lutensol LT 30" ® by BASF), |
| 0.1 | The sodium salt of a $C_{12}$–$C_{18}$—fatty alcohol mixture reacted with 2 mols of ethylene oxide and sulfated, |
| 0.5 | Aqueous ammonia solution (25%) |
| 0.05 | Polyoxyethylene glycol ether with a molecular weight of about 600,000 ("POLYOX WSR 205" ® by UCC), |
| 0.001 | Dyes, |
| Balance | to 100%, demineralized water. |

The antifogging effect on mirrors was compared with a product of the same composition, which contained, however, instead of the "POLYOX" ®, an equal amount of styrene/maleic anhydride copolymer according to U.S. Pat. No. 3,696,043. Both products showed a good antifogging effect when applied as a 1% solution. Then both products were used on naturally soiled window panes, also as a 1% solution. With the window cleanser according to the invention, a completely streak-free glass surface was obtained, while the reference product left a film which could only be removed by subsequent rinsing with clear water. The two products were in addition tested by professional window cleaners for six weeks. An inquiry showed that the formulation according to the invention was judged better, as far as cleaning action, absence of residues, and easy wipability are concerned, than the reference product and other preparations used by them before.

EXAMPLE 2

A window cleanser of the following composition was prepared:

| Percent by Weight | |
|---|---|
| 1.0 | The adduct of 10 mols of ethylene oxide onto a $C_{11}$–$C_{14}$—alkanediol, |
| 0.5 | $C_{10}$–$C_{13}$—alkylbenzene sulfonate, Na salt, |
| 0.05 | Polyoxyethylene glycol ether with a molecular weight of about 400,000 ("POLYOX WSR N-3000" ® by UCC), |
| 0.5 | Aqueous ammonia solution (25%), |
| Balance | to 100% demineralized water. |

Window panes greatly soild by cigarette smoke condensate and their plastic frames could be cleaned streak-free with this product in a 1% solution.

In comparison, a product with a content of styrene/maleic anhydride copolymer, with the same surface-active compound content and the same concentration, left some streaks on the windows and the frames were not completely clean.

The antifogging effect on bathroom mirrors after running hot water into the tub was good in both products.

EXAMPLE 3

A window cleanser of the following composition was prepared:

| Percent by Weight | |
|---|---|
| 3.0 | $C_{10}$–$C_{13}$—alkylbenzene sulfonate, Na salt, |
| 0.5 | Nonylphenyl adducted with 10 mols of ethylene oxide, |
| 0.1 | Polyoxyethylene glycol ether with a molar weight of about 600,000 ("POLYOX WSR 205" ® by UCC), |
| 0.001 | Dye, |
| 0.1 | Perfume, |
| Balance | to 100%, demineralized water. |

The product in a 1% solution cleaned windows which had been exposed to heavy street traffic without leaving streaks. Compared to a commercial window cleanser without a polymer content, the residue-free cleaning effect was not only better but the wiping was clearly easier.

The preceding specific embodiments are illustrative of the practice of the invention. It is to be understood, however, that other expedients known to those skilled in the art or disclosed herein may be employed without departing from the spirit of the invention or the scope of the appended claims.

We claim:

1. Aqueous-based cleansers for windows, mirrors and reflecting surfaces, free of builder salts and organic solvents consisting essentially of:

from 0.01% to 0.5% by weight of a water-soluble, nonionic polyoxyethylene glycol polymer having a molecular weight of between 300,000 and 4,000,000, from 0.1% to 5% by weight of at least one water-soluble, synthetic surface-active compound selected from the group consisting of synthetic anionic surface-active compounds, nonionic surface-active compounds, cationic surface-active compounds, and compatible mixtures thereof, from 0 to 5% by weight of water-soluble, alkaline-reacting compounds selected from the group consisting of alkali metal and ammonium hydroxides, alkali metal and ammonium carbonates, alkali metal and ammonium bicarbonates, monoalkylamines having 1 to 4 carbon atoms, dialkylamines having 1 to 4 carbon atoms in each alkyl, trialkylamines having 1 to 4 carbon atoms in each alkyl, mono-, di- and tri-alkylolamines having 2 to 4 carbon atoms in each alkylol, cycloalkylamines and morpholine, from 0 to 1% by weight of customary auxiliary agents selected from the group consisting of odorants, colorants and preservatives, and the remainder to 100% by weight of demineralized water.

2. The aqueous-based cleanser of claim 1 wherein from 0.05% to 0.2% by weight of said water-soluble, nonionic polyoxyethylene glycol polymer is present.

3. The aqueous-based cleanser of claim 1 or 2 wherein said water-soluble, nonionic polyoxyethylene glycol polymer has a molecular weight of between 500,000 and 1,000,000.

4. The aqueous-based cleanser of claim 1 or 2 wherein from 0.5% to 5% by weight of said at least one water-soluble, synthetic surface-active compound is present.

5. The aqueous-based cleanser of claim 1 wherein from 0.1% to 2% by weight of said water-soluble, alkaline-reacting compounds are present.

6. The aqueous-based cleanser of claim 1 or 2 wherein from 0.5% to 5% by weight of at least one water-soluble, synthetic surface-active compound are present as synthetic anionic surface-active compounds of the sulfonate and sulfate types and nonionic surface-active compounds in an anionic to nonionic ratio of 100:0 to 1:20.

7. The aqueous-based cleanser of claim 5 wherein said alkaline-reacting compound is ammonium hydroxide.

8. An aqueous-based cleanser for windows, mirrors and reflecting surfaces, free of builder salts and organic solvents consisting essentially of:

from 0.05% to 0.2% by weight of a water-soluble, nonionic polyoxyethylene glycol polymer having a molecular weight of between 300,000 and 4,000,000, from 0.5% to 5% by weight of at least one water-soluble, synthetic surface-active compound consisting of synthetic anionic surface-active compounds of the sulfonate and sulfate types and nonionic surface-active compounds in an anionic to nonionic ratio of 100:0 to 1:20.

from 0 to 5% by weight of water-soluble, alkaline-reacting compounds selected from the group consisting of alkali metal and ammonium hydroxides, alkali metal and ammonium carbonates, alkali metal and ammonium bicarbonates, monoalkylamines having 1 to 4 carbon atoms, dialkylamines having 1 to 4 carbon atoms in each alkyl, trialkylamines having 1 to 4 carbon atoms in each alkyl, mono-, di- and tri-alkylolamines having 2 to 4 carbon atoms in each alkyl, cycloalkylamines and morpholine, from 0 to 1% by weight of customary auxiliary agents selected from the group consisting of odorants, colorants and preservations, and the remainder to 100% by weight of demineralized water.

9. The aqueous-based cleanser of claim 8 wherein said water-soluble, nonionic polyoxyethylene glycol polymer has a molecular weight of between 500,000 and 1,000,000.

10. The aqueous-based cleanser of claim 8 wherein from 0.1% to 2% by weight of said water-soluble, alkaline-reacting compounds are present.

* * * * *